US008267815B2

(12) United States Patent
Braun et al.

(10) Patent No.: US 8,267,815 B2
(45) Date of Patent: Sep. 18, 2012

(54) NOCK ADAPTER FOR BOWFISHING ARROW

(75) Inventors: Cindy R. Braun, Stratford, WI (US); Jeffrey Braun, Stratford, WI (US)

(73) Assignee: AMS, LLC, Stratford, WI (US)

( * ) Notice: Subject to any disclaimer, the term of this patent is extended or adjusted under 35 U.S.C. 154(b) by 0 days.

(21) Appl. No.: 13/039,468

(22) Filed: Mar. 3, 2011

(65) Prior Publication Data

US 2011/0218062 A1 Sep. 8, 2011

Related U.S. Application Data

(60) Provisional application No. 61/339,488, filed on Mar. 5, 2010.

(51) Int. Cl.
*F42B 6/06* (2006.01)

(52) U.S. Cl. ..... 473/578; 473/586

(58) Field of Classification Search ..... 473/578, 473/585, 586

See application file for complete search history.

(56) References Cited

U.S. PATENT DOCUMENTS

| | | | | | |
|---|---|---|---|---|---|
| 2,747,876 | A | | 8/1953 | Teller | |
| 4,874,180 | A | * | 10/1989 | Fingerson et al. | 473/578 |
| 5,067,731 | A | | 11/1991 | Bickel | |
| 5,094,464 | A | | 3/1992 | Musacchia, Sr. | |
| 5,306,020 | A | * | 4/1994 | Bolf | 473/578 |
| 5,417,439 | A | | 5/1995 | Bickel | |
| 5,823,902 | A | * | 10/1998 | Guest et al. | 473/578 |
| 5,919,105 | A | | 7/1999 | Summers | |
| 5,971,875 | A | * | 10/1999 | Hill | 473/578 |
| 5,987,724 | A | * | 11/1999 | Kleman | 29/401.1 |
| 6,517,453 | B2 | | 2/2003 | LaSee | |
| 6,634,350 | B2 | | 10/2003 | LaSee | |

* cited by examiner

*Primary Examiner* — John Ricci
(74) *Attorney, Agent, or Firm* — Boyle Fredrickson, S.C.

(57) ABSTRACT

A nock adapter for a solid shaft bowfishing arrow fits on a standard conical taper of a solid shaft arrow and provides an extended cylindrical joint releasably engaging a cylindrical boss of a nock for field replacement of the nock while resisting lateral disengaging impacts.

12 Claims, 2 Drawing Sheets

NOCK ADAPTER FOR BOWFISHING ARROW

CROSS-REFERENCE TO RELATED APPLICATIONS

This application claims the benefit of U.S. patent application 61/339,488 filed Mar. 5, 2010 and hereby incorporated by reference.

FIELD OF THE INVENTION

The present invention relates to arrows used for bowfishing and in particular to a nock adapter suitable for use with such arrows.

BACKGROUND OF THE INVENTION

A nock is the portion of an arrow that receives the bowstring to hold the end of the arrow in alignment with the bowstring prior to release. A nock may be a simple notch in the end of the arrow but more typically is a separate part which may be attached to the arrow.

It is known to provide for nock adapters that serve to releaseably hold a nock to the arrow shaft permitting simplifying the replacement of the nock or the use of different nocks. For conventional arrows having tubular shafts, the nock adapter may include a foreword extending cylindrical boss that may fit within the tube of the arrow and it may provide an opposed bore for receiving a corresponding cylindrical boss of the nock.

Bowfishing is a form of archery using arrows specially adapted for fishing. Bowfishing arrows normally do not have fletching (feathers) which may cause the arrow to move erratically in the water and may have a barbed arrowhead that allows for the releasing of the fish. Bowfishing arrows are normally attached to a tether that automatically follows the flight of the arrow and provides a means for retrieving the arrow and fish.

Bowfishing arrows are typically solid shaft arrows, for example, constructed of fiberglass-reinforced polymer. Such arrows often provide a tapered rear end to be received by a conical bore in the nock which is glued to this taper. A nock adapter suitable for use with standard solid shaft arrows having tapered rear ends is taught in U.S. Pat. No. 5,919,105 hereby incorporated by reference. This nock adapter provides for a conical bore that may be attached to the conical end of the arrow and which provides an opposed conical projection and snap fitting that may be received and retained by a conical bore of a nock specially designed to engage the snap fitting.

The nocks of bowfishing arrows, because of their intended use, are frequently exposed to sideward impacts caused by a striking of the arrow against the boat, the river bottom or the like such as may dislodge or break the nock. Accordingly, any attachment method for a bowfishing arrow must resist strong dislodgment forces.

SUMMARY OF THE INVENTION

The present invention provides a nock adapter for bowfishing arrows that provides opposed conical and cylindrical bores allowing an improved engagement between the nock and the nock adapter by a simple press fit. This attachment method permits replacement of a nock while retaining the nock against dislodgment by sideward blows. It has been determined that high-strength materials can accommodate the additional torsional forces on the adapter caused by its increased length and that such materials may be suitably bonded to the arrow shaft.

Specifically, the present invention provides an arrow assembly including a solid arrow shaft extending along an axis and having a conically tapered rear end and an adapter having a forwardly open conical bore receiving the rear end of the arrow shaft to align an axis of the adapter with the arrow axis by interfitting of the conical bore and tapered rear end and having a rearwardly opening bore with substantially parallel wall. A nock having a bifurcated rearward portion provides opposed fingers for fitting a bowstring therebetween and has a forwardly extending boss adapted to press fit within the rearwardly opening bore of the adapter to align the nock with the arrow axis.

It is thus a feature of at least one embodiment of the invention to provide a nock adapter permitting simple replacement of nocks on bowfishing arrows while resisting dislodgment of the nocks with anticipated sideward impacts.

The rearwardly extending bore of the adapter is substantially cylindrical.

It is thus a feature of at least one embodiment of the invention to provide a simple joint between the nock and the nock adapter that can be used with readily available nocks.

The rearwardly extending bore of the adapter may have an axial length no less than one and one half times its inner diameter.

It is thus a feature of at least one embodiment of the invention to provide a joint that does not require particular ancillary attachment methods such as snaps or threads for retaining a nock in engagement and alignment The conically tapered rear end of the arrow may be conical or frusto-conical.

It is thus a feature of at least one embodiment of the invention to work with a variety of solid shaft arrows using a readily fabricated joint shape.

The forwardly open conical bore of the adapter may include a counterbore at its apex providing a glue relief volume.

It is thus a feature of at least one embodiment of the invention to permit the use of the nock adapter with conically tipped arrows without misalignment caused by float of the nock adapter on an adhesive layer.

The adapter may be nylon

It is thus a feature of at least one embodiment of the invention to provide a material that may resist strong impacts expected with bowfishing arrows and yet which may be attached to a bowfishing arrow by adhesive.

The forward extending boss of the nock is substantially cylindrical and/or may provide a set of diametrically protruding ridges extending along an axis of the boss.

It is thus a feature of at least one embodiment of the invention to provide a simple joint that may be press fit or released in the field without special equipment.

The adapter may have a cylindrical outer periphery substantially equal to a diameter of a cylindrical outer periphery of the solid arrow It is thus a feature of at least one embodiment of the invention to preserve the aerodynamic integrity of the arrow.

The nock may be a thermoplastic material different from the adapter.

It is thus a feature of at least one embodiment of the invention to provide an adapter likely to survive with the impacts that would break nocks.

The nock may provide a maximum diametrical extent no greater than a diameter of a cylindrical outer periphery of the adapter It is thus a feature of at least one embodiment of the invention to provide an adapter that preserves the aerodynamic properties of the arrow.

Other features and advantages of the invention will become apparent to those skilled in the art upon review of the following detailed description, claims and drawings in which like numerals are used to designate like features.

DETAILED DESCRIPTION OF THE PREFERRED EMBODIMENT

Figure 1:
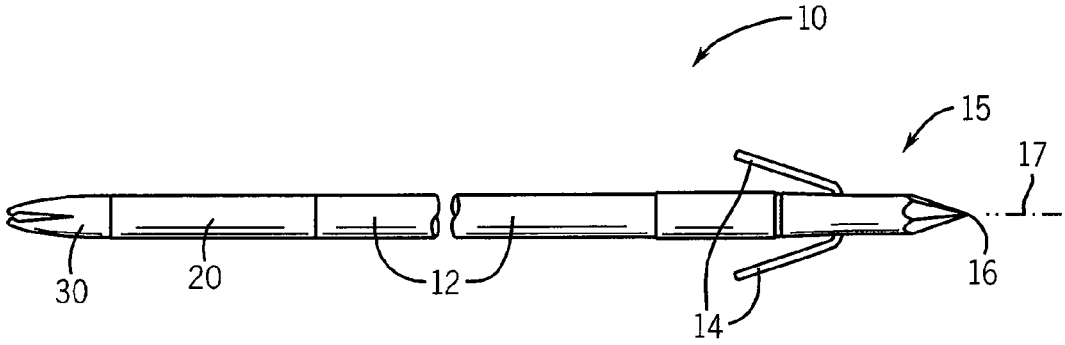
FIG. 1 is a fragmentary side elevational view of an arrow having a nock adapter of the present invention.

Referring now to FIG. 1 a bow-fishing arrow 10 may have a shaft 12, for example, of fiberglass-reinforced polymer, carbon reinforced polymer or fiberglass carbon polymer extending generally along an axis 17 and having a diameter of substantially 0.3 inches and between ¼" and ⅜". A forward end of the shaft 12 may attach to an arrowhead 15 having rearwardly angled extending barbs 14.

The arrowhead 15 may be, for example, an AMS Shure Shot Arrow point commercially available from AMS Bowfishing of Stratford, Wis. providing a sharpened metallic tip 16 and incorporating a screw mechanism (not shown) allowing a turning of the shaft 12 with respect to the arrowhead 15 to release the barbs 14 for withdrawal of the arrowhead 15 from a fish (not shown) without the need to push the point through the fish.

Figure 2:
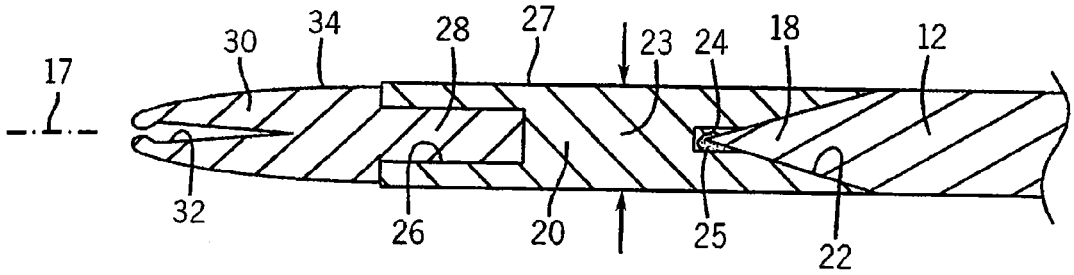
FIG. 2 is a detailed cross-section of the nock adapter of FIG. 1 as fit to the arrow shaft and a nock.
Figure 3:
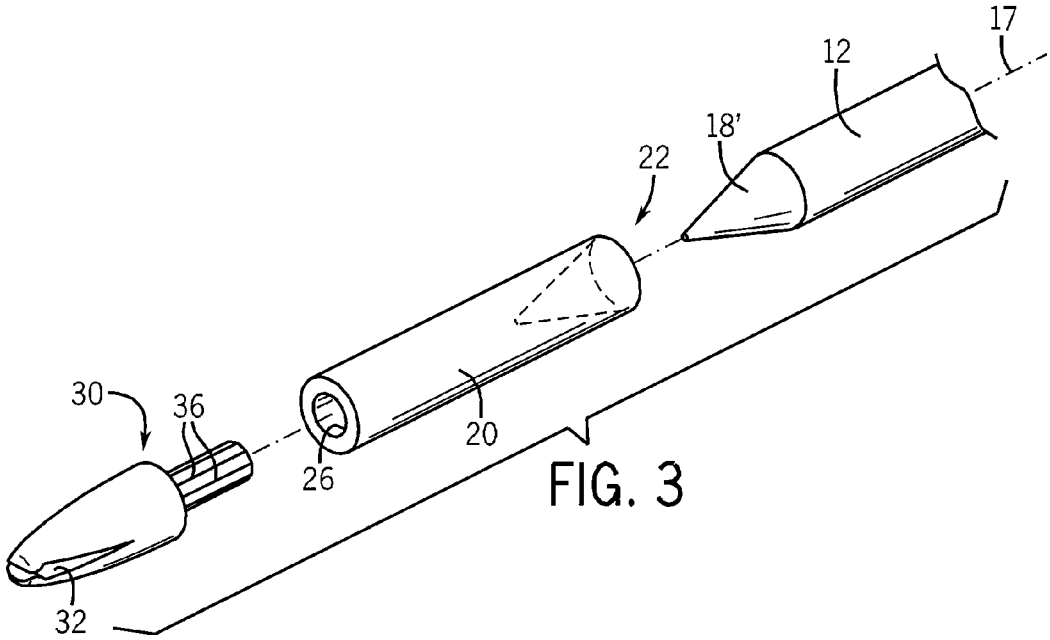
FIG. 3 is a fragmentary perspective view in exploded form of the nock adapter, arrow shafts, and nock of FIG. 2.

Referring also to FIGS. 2 and 3, a rear end of the shaft 12 may be sharpened into a conical tip 18 (or a frusto-conical tip 18') according to prior art techniques intended to allow attachment of the shaft 12 to a nock (not shown) having a corresponding conical bore. The conical forming of the rear end of the shaft 12 may be done simply by a centerless grinding operation.

The nock adapter 20 of the present invention may provide for a cylindrical outer surface 27 generally having a diameter 23 generally matching the corresponding diameter of the cylindrical outer surface of the shaft 12 (e.g. having equal diameters) and a forward facing conical bore 22 sized to conform with the angle of the conical tip 18 of the shaft 12. The angle of the conical bore 22 may be, for example, substantially 23° and centered about the axis 17. The conical bore 22 may terminate in a cylindrical counter bore 24 extending from its apex having a diameter, for example, of 0.145 inches. The cylindrical counter bore 24 provides a relief for adhesive 25 used to attach the nock adapter 20 to the shaft 12. The adhesive may be, for example, a two-part epoxy adhesive, a cyanoacrylate adhesive, or the like. The nock adapter 20 may have a length of substantially 1.5 inches and between 1 and 2.5 inches.

A rear end of the nock adapter 20 provides a rearwardly opening, axially centered cylindrical bore 26 size to receive a corresponding cylindrical boss 28 of a standard nock 30. The cylindrical bore 26 may have, for example, a diameter of substantially 0.245 inches. The cylindrical boss 28 may provide for a series of radially extending ribs 36 parallel to the axis 17 providing control of the frictional force of engagement and retention of the boss 28 within the bore 26.

The nock 30, per conventional design, may have a rearwardly exposed slot 32 for receipt of a bowstring (not shown). Desirably, the maximum outer circumference 34 of the nock 30 is less than or equal to the outer circumference of the nock adapter 20 and shaft 12 to reduce turbulence and arrow weight.

Before use, the nock adapter 20 may be attached to the shaft 12 by adhesive which may be allowed to cure. A nock 30 may then be installed on the nock adapter 20 pressing the boss 28 into the bore 26 to be retained therein by frictional contact. In the event that the nock 30 is damaged, it may be pulled from the bore 26 and a new nock replaced in the field without adhesive.

Desirably, the nock adapter 20 is made of a material that may be adhesively attached to the shaft 12 and which provides for sufficient strength to not be broken under forces that would break the nock 30. High-strength nylon or aluminum are believed to be suitable for this purpose.

Figure 4:
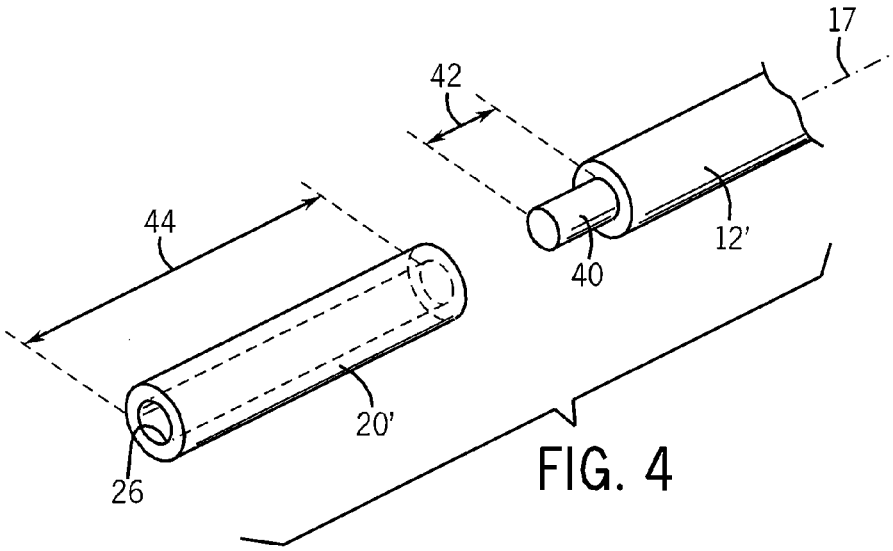
FIG. 4 is a figure similar to that of FIG. 3 showing an alternative embodiment of the nock adapter.

Referring now to FIG. 4, in an alternative embodiment, the nock adapter 20' may provide for a substantially continuous axial bore 26, for example, conforming to the diameter of the boss 28 of the nock 30 (shown in FIG. 2) and extending the entire length of the nock adapter 20' along axis 17. Attachment of the arrow shaft 12' to the nock adapter 20' may be accomplished by means of a reduced diameter portion 40 machined on the rear end of the shaft 12' providing a cylinder with a diameter less than the arrow shaft 12' and coaxial with the axis of 17 and extending rearward from the arrow shaft 12' by a distance of 42 approximately one half of the axial length 44 of the nock adapter 20'. The diameter of the reduced diameter portion 40 is substantially equal to the diameter of the bore 26 and may be fit within the bore 26 and held by adhesive. The reduced diameter portion 40 produces an arrow shaft 12' that is not compatible with readily available nocks 30.

Certain terminology is used herein for purposes of reference only, and thus is not intended to be limiting. For example, terms such as "upper", "lower", "above", and "below" refer to directions in the drawings to which reference is made. Terms such as "left", "right", "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. An arrow assembly comprising:

a solid arrow shaft extending along an axis and having a conically tapered rear end;

an adapter having a forwardly open conical bore receiving the rear end of the arrow shaft to align an axis of the adapter with the arrow axis by interfitting of the conical bore and tapered rear end and having a rearwardly opening bore with substantially parallel walls; and a nock having a bifurcated rearward portion providing opposed fingers for fitting a bowstring therebetween and having a forwardly extending boss adapted to press fit within the rearwardly opening bore of the adapter to align the nock with the arrow axis;

wherein the nock provides a maximum diametrical extent less than a diameter of a cylindrical outer periphery of the adapter.

2. The arrow assembly of claim 1 wherein the rearwardly extending bore of the adapter is substantially cylindrical.

3. The arrow assembly of claim 1 wherein the conically tapered rear end of the arrow is conical.

4. The arrow assembly of claim 1 wherein the conically tapered rear end of the arrow is frusto-conical.

5. The arrow assembly of claim 1 wherein the adapter is selected from the group consisting of nylon and aluminum.

6. The arrow assembly of claim 1 wherein the forward extending boss of the nock is substantially cylindrical.

7. The arrow assembly of claim 1 wherein the adapter has a cylindrical outer periphery substantially equal to a diameter of a cylindrical outer periphery of the solid arrow shaft.

8. The arrow assembly of claim 1 wherein the nock is a thermoplastic material different from the adapter.

9. The arrow assembly of claim 1 wherein further including an adhesive providing a joint between the adapter and the arrow shaft.

10. An arrow assembly comprising:

a solid arrow shaft extending along an axis and having a conically tapered rear end;

an adapter having a forwardly open conical bore receiving the rear end of the arrow shaft to align an axis of the adapter with the arrow axis by interfitting of the conical bore and tapered rear end and having a rearwardly opening bore with substantially parallel walls;

a nock having a bifurcated rearward portion providing opposed fingers for fitting a bowstring therebetween and having a forwardly extending boss adapted to press fit within the rearwardly opening bore of the adapter to align the nock with the arrow axis wherein the rearwardly extending bore of the adapter is substantially cylindrical; and wherein the rearwardly extending bore of the adapter has an axial length no less than one and one half times its inner diameter.

11. An arrow assembly comprising:

a solid arrow shaft extending along an axis and having a conically tapered rear end;

an adapter having a forwardly open conical bore receiving the rear end of the arrow shaft to align an axis of the adapter with the arrow axis by interfitting of the conical bore and tapered rear end and having a rearwardly opening bore with substantially parallel walls; and a nock having a bifurcated rearward portion providing opposed fingers for fitting a bowstring therebetween and having a forwardly extending boss adapted to press fit within the rearwardly opening bore of the adapter to align the nock with the arrow axis wherein the forwardly open conical bore of the adapter includes a counterbore at its apex providing a glue relief volume.

12. An arrow assembly comprising:

a solid arrow shaft extending along an axis and having a conically tapered rear end;

an adapter having a forwardly open conical bore receiving the rear end of the arrow shaft to align an axis of the adapter with the arrow axis by interfitting of the conical bore and tapered rear end and having a rearwardly opening bore with substantially parallel walls; and a nock having a bifurcated rearward portion providing opposed fingers for fitting a bowstring therebetween and having a forwardly extending boss adapted to press fit within the rearwardly opening bore of the adapter to align the nock with the arrow axis wherein the forward extending boss of the nock is substantially cylindrical wherein the forward extending boss of the nock provides a set of diametrically protruding ridges extending along an axis of the boss.

* * * * *